US008072303B2

(12) United States Patent
Oki

(10) Patent No.: US 8,072,303 B2
(45) Date of Patent: Dec. 6, 2011

(54) INDUCTOR

(75) Inventor: Juichi Oki, Tokyo (JP)

(73) Assignee: Sumida Corporation, Tokyo (JP)

( * ) Notice: Subject to any disclaimer, the term of this patent is extended or adjusted under 35 U.S.C. 154(b) by 224 days.

(21) Appl. No.: 12/225,232

(22) PCT Filed: Feb. 26, 2007

(86) PCT No.: PCT/JP2007/053488
§ 371 (c)(1),
(2), (4) Date: Sep. 17, 2008

(87) PCT Pub. No.: WO2007/119294
PCT Pub. Date: Oct. 25, 2007

(65) Prior Publication Data

US 2009/0315660 A1 Dec. 24, 2009

(30) Foreign Application Priority Data

Mar. 20, 2006 (JP) ..... 2006-076486

(51) Int. Cl.
*H01F 27/29* (2006.01)
*H01F 5/00* (2006.01)
*H01F 27/02* (2006.01)
*H01F 7/06* (2006.01)

(52) U.S. Cl. ..... 336/192; 336/83; 336/200; 29/602.1; 29/605

(58) Field of Classification Search ..... 336/192, 336/83, 15, 107, 200; 29/605, 602.1
See application file for complete search history.

(56) References Cited

U.S. PATENT DOCUMENTS

| | | | | |
|---|---|---|---|---|
| 6,292,083 | B1 * | 9/2001 | Tajima et al. | 336/192 |
| 6,661,323 | B2 * | 12/2003 | Chang et al. | 336/65 |
| 7,898,822 | B2 * | 3/2011 | Feist et al. | 361/836 |
| 2002/0190830 | A1 * | 12/2002 | Matsumoto et al. | 336/83 |
| 2005/0001705 | A1 * | 1/2005 | Watanabe | 336/83 |
| 2005/0017835 | A1 * | 1/2005 | Oki | 336/65 |
| 2006/0267716 | A1 * | 11/2006 | Peng et al. | 336/83 |
| 2007/0188286 | A1 * | 8/2007 | Yoshimoto et al. | 336/192 |
| 2009/0179724 | A1 * | 7/2009 | Sano et al. | 336/221 |

FOREIGN PATENT DOCUMENTS

CN 1143330 C 3/2004

(Continued)

OTHER PUBLICATIONS

Nov. 10, 2010 Office Action issued in Chinese Patent Application No. 200780010027.7 (with partial translation).

*Primary Examiner* — Anh Mai
*Assistant Examiner* — Mangtin Lian
(74) *Attorney, Agent, or Firm* — Oliff & Berridge, PLC

(57) ABSTRACT

An inductor is arranged such that the projection area of each terminal portion falls within a square circumscribing the projection area of an upper flange portion under a state where the inductor is projected orthogonally in the direction of the axis. Projection area of each end of a winding connected to the joint of the terminal portions also falls within the square. Consequently, an installation space can be secured easily on a board, and a space saving inductor in which a space for installation of other components can be secured easily on the periphery can be obtained.

8 Claims, 6 Drawing Sheets

FOREIGN PATENT DOCUMENTS

| | | | |
|---|---|---|---|
| CN | 100545961 | C | 9/2009 |
| JP | U-05-043511 | | 6/1993 |
| JP | A-07-263251 | | 10/1995 |
| JP | A-09-213539 | | 8/1997 |
| JP | A-10-022137 | | 1/1998 |
| JP | A-11-008133 | | 1/1999 |
| JP | A-2003-347131 | | 12/2003 |
| JP | A-2005-285901 | | 10/2005 |
| JP | A-2006-013150 | | 1/2006 |

* cited by examiner

[Figure 1]
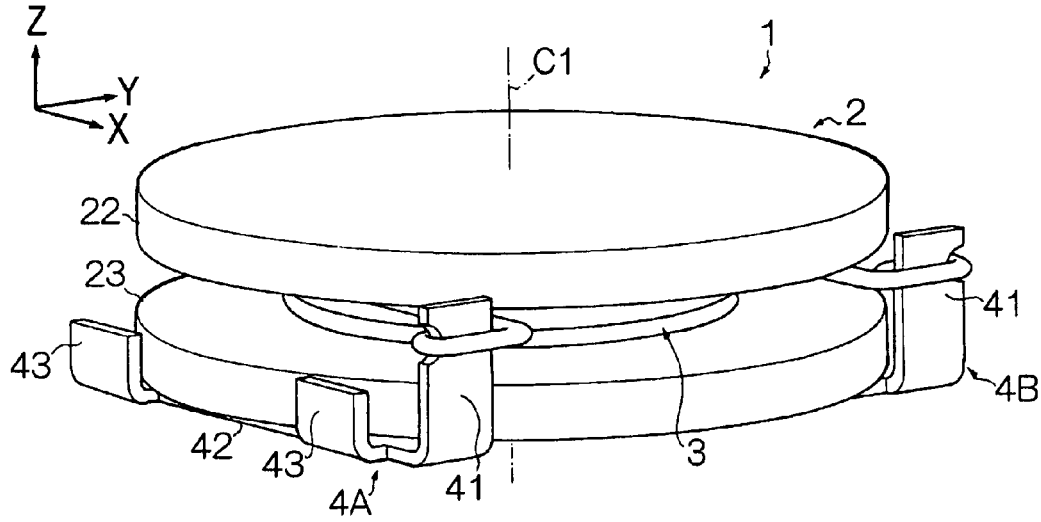
[Figure 2]
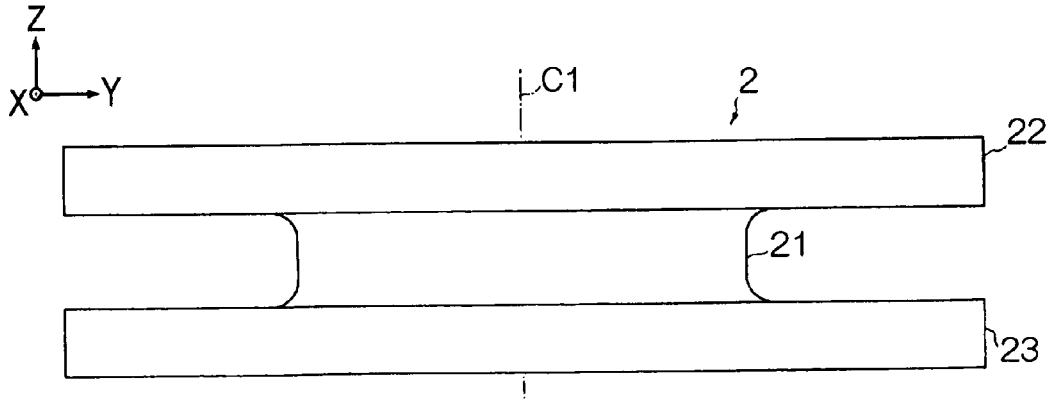

[Figure 3]
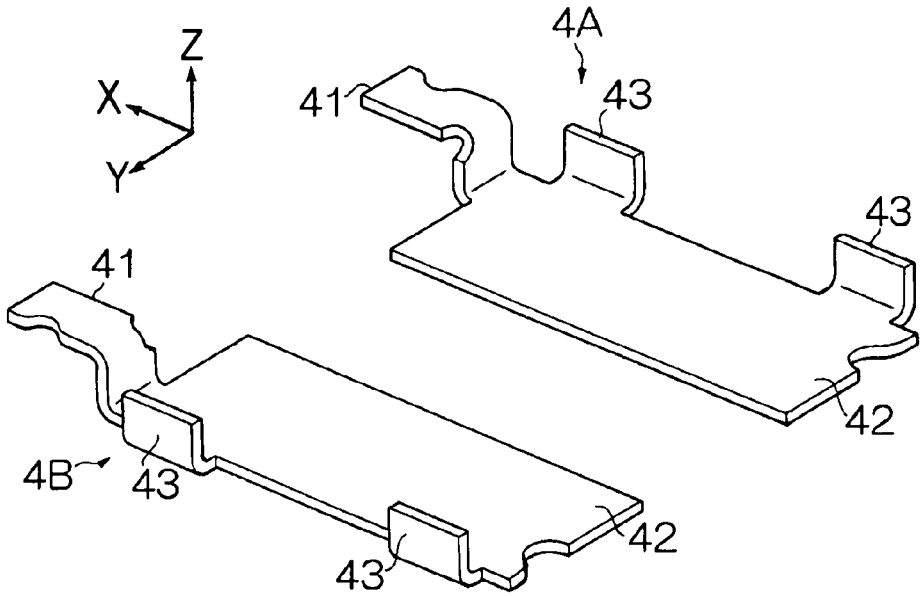
[Figure 4]
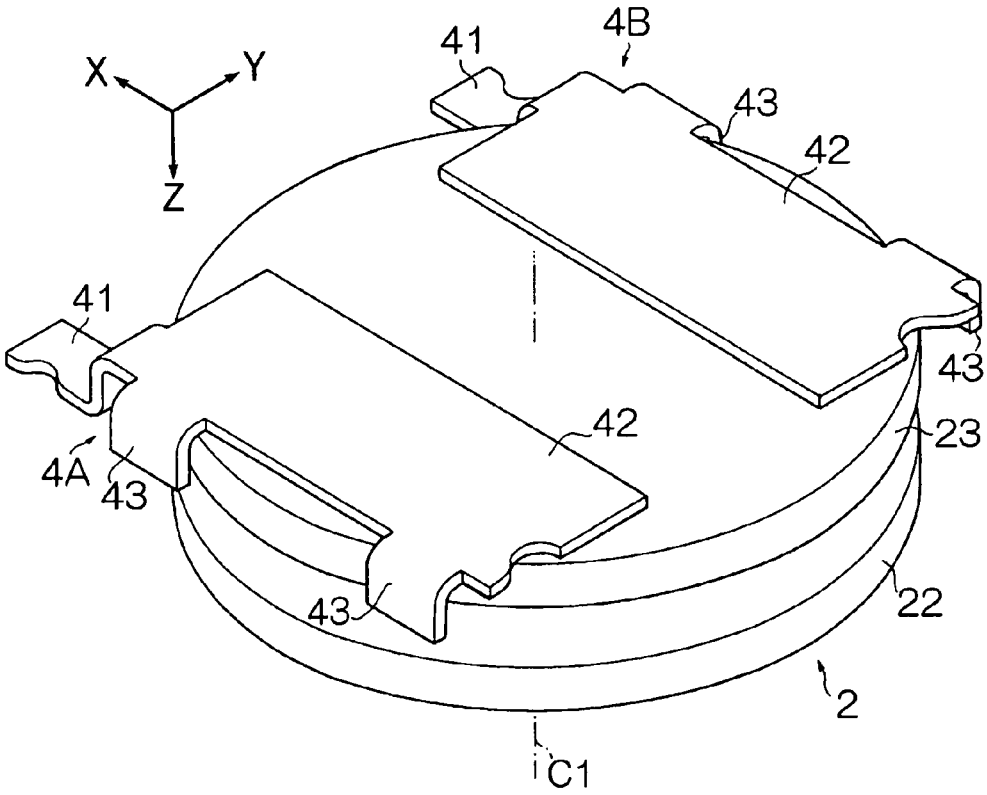

[Figure 5]
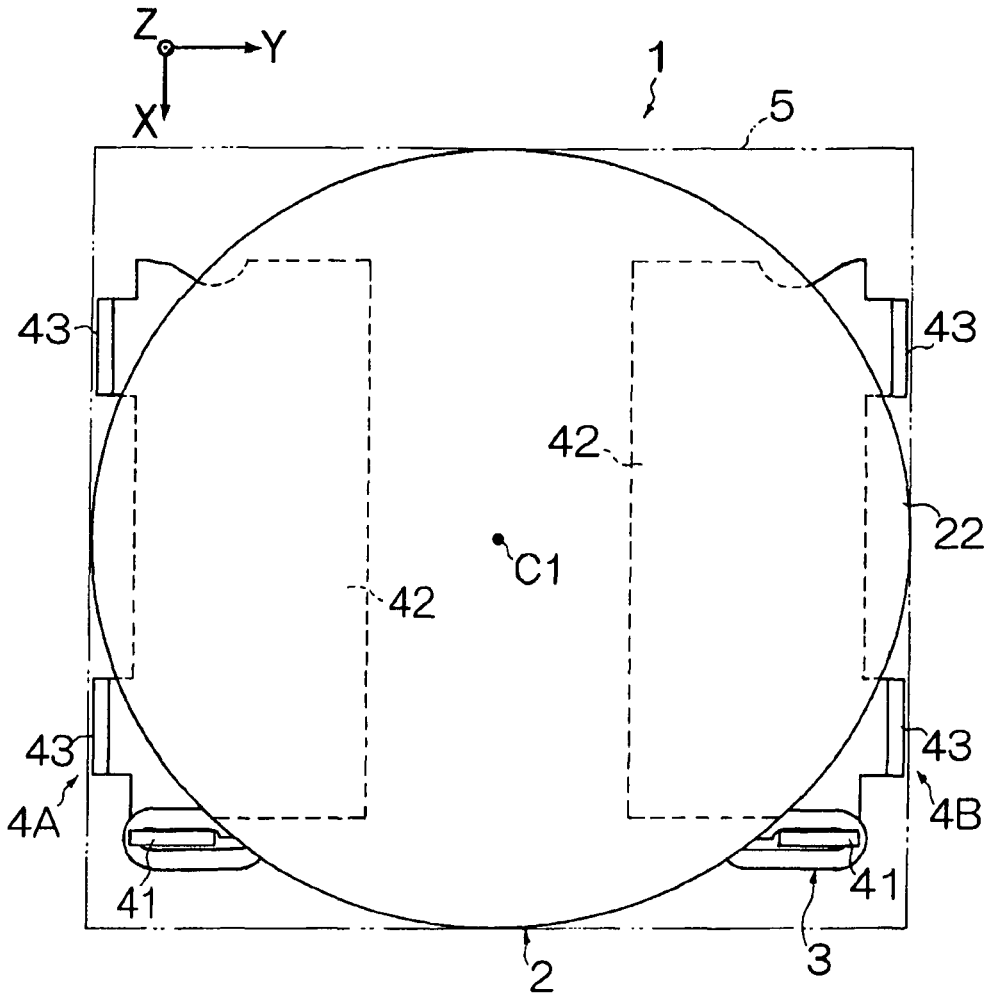

[Figure 6]
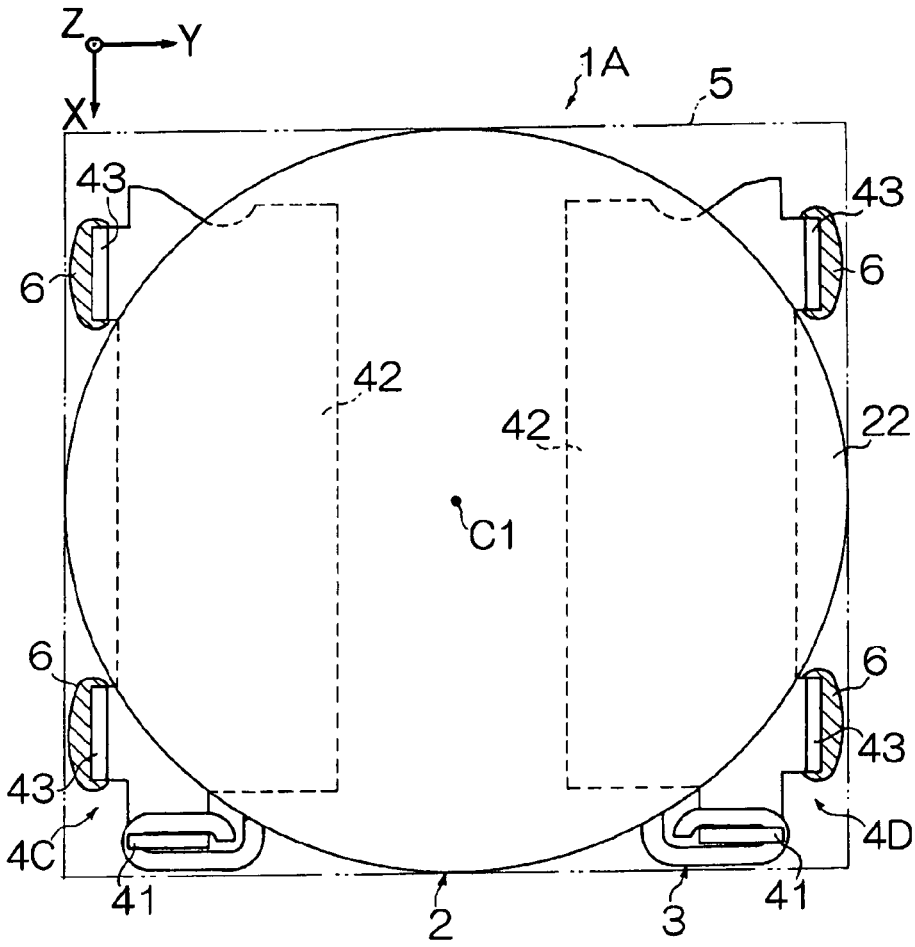

[Figure 7]
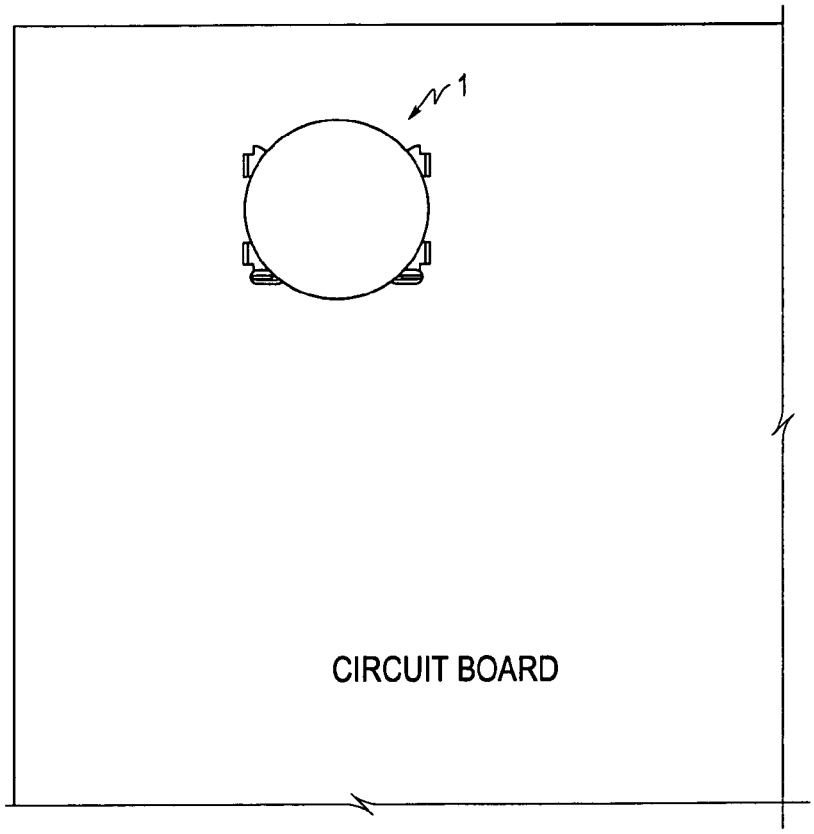

[Figure 8]
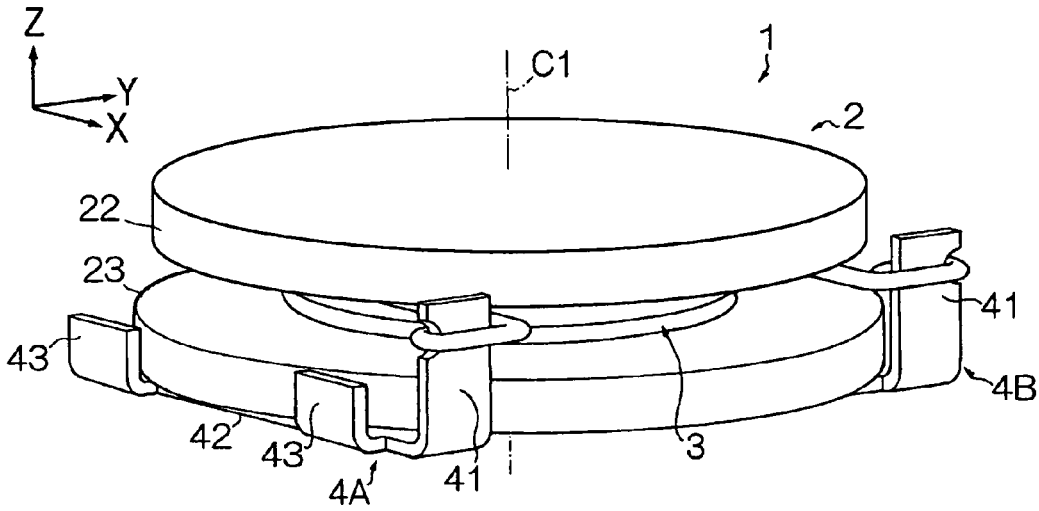

INDUCTOR

TECHNICAL FIELD

The present invention relates to an inductor having a drum core around which a winding is wound and a terminal portion formed by a metal plate member securely fixed to the drum core. In particular, it relates to an inductor suitable for use in a power supply circuit of an electronic device that is highly required to be downsized (or slimmed down), such as a cellular phone, a portable music player, a portable video game machine and a compact camcorder.

BACKGROUND ART

A known inductor of this type is described in the patent document listed below. The inductor described in the patent document has small strip-shaped protrusions that are formed along an edge of a metal plate member (a metal piece) forming a connecting terminal portion and an electrode portion and abut on the side surface of a lower flange portion of a drum core, and the small strip-shaped protrusions improve the precision of positioning of the drum core and the metal plate member.

Patent document 1: Japanese Unexamined Patent Publication No. 10-22137

DISCLOSURE OF THE INVENTION

Problems to be Solved by the Invention

Recently, electronic devices using inductors of this kind have been downsized, and in keeping with this trend, the demand for smaller inductors used in the circuit boards of those devices has been increasing. In particular, in order to pack more electric (electronic) components in smaller circuit boards, a space saving inductor is needed which not only requires only a small installation area on the board but also facilitates securing of the space for installation of other components around the inductor.

The present invention has been made in view of such circumstances, and an object of the present invention is to provide an inductor that facilitates securing of a space for installation thereof on a board and securing of a space for installation of another component around the inductor.

Means for Solving the Problems

In order to attain the object described above, an inductor according to the present invention comprises: a drum core that has a winding portion and roughly circular flange portions formed at the both ends of the winding portion; a winding that is wound around the winding portion; and a terminal portion being formed by a metal plate member and being securely fixed to an end face of one of the flange portions and has a joint to which an end of the winding is connected and a mounting part at which the inductor is mounted on a board, and characterized in that, in the orthogonal projection of the inductor in the direction of an axis of the winding portion, the projection area of the terminal portion at least falls within a square that circumscribes the projection area of the flange portion of the flange portions that has a larger or equal diameter.

The inductor according to the present invention is preferably configured so that, in the orthogonal projection, the projection area of a solder fillet formed by soldering of the terminal portion to the board falls within the square.

In the inductor according to the present invention, the flange portions can have the same outer dimensions.

EFFECT OF THE INVENTION

Since the inductor according to the present invention is configured so that, in the orthogonal projection of the inductor in the direction of an axis of the winding portion, the projection area of the terminal portion at least falls within a square that circumscribes the projection area of the flange portion of the flange portions that has a larger or equal diameter, the installation space of the inductor on the board is limited to within the predetermined square area. Therefore, compared with conventional inductors whose installation spaces are not limited to within a square area, the space for installation of the inductor can be easily secured on the board, and another component can be efficiently and compactly arranged in the area around the predetermined square area.

BRIEF DESCRIPTION OF THE DRAWINGS

FIG. 1 is a perspective view of an inductor according to an embodiment viewed from the front side;

FIG. 2 is a front view of a drum core shown in FIG. 1;

FIG. 3 is a perspective view of terminal portions shown in FIG. 1 viewed from the rear side;

FIG. 4 is a perspective view showing the terminal portions securely fixed to the drum core viewed from the bottom side;

FIG. 5 is a plan view of the inductor according to the embodiment; and

FIG. 6 is a plan view of an inductor according to another embodiment of the present invention.

FIG. 7 shows the inductor mounted on a circuit board.

FIG. 8 is based on FIG. 1 and shows the upper flange portion made smaller than the lower flange portion.

DESCRIPTION OF SYMBOLS

1, 1A inductor
2 drum core
3 winding
4A-4D terminal portion
5 square
6 solder fillet
21 winding portion
22 upper flange portion
23 lower flange portion
41 joint
42 mounting part
43 claw part
C1 axis

BEST MODE FOR CARRYING OUT THE INVENTION

In the following, inductors according to embodiments of the present invention will be described in detail with reference to the accompanying drawings. FIGS. 1 to 5 show an inductor according to an embodiment of the present invention, and FIG. 6 shows another embodiment. In the following description, the direction of the X axis of the three-dimensional orthogonal coordinate system shown in FIG. 1 will be described as the back-and-forth direction (the arrow points to the front), the direction of the Y axis will be described as the horizontal direction (the arrow points to the right), and the direction of the Z axis will be described as the vertical direction (the arrow points to the top). The three-dimensional orthogonal coordinate systems shown in the remaining drawings have the same coordinate axes as that shown in FIG. 1.

First, with reference to FIGS. 1 to 4, a configuration of an inductor according to an embodiment of the present invention will be described. FIG. 1 is a perspective view showing a configuration of the whole of an inductor according to an embodiment of the present invention, viewed from the front side. FIG. 2 is a front view of a drum core shown in FIG. 1. FIG. 3 is a perspective view of terminal portions shown in FIG. 1, viewed from the rear side. FIG. 4 is a perspective view showing the terminal portions securely fixed to the drum core, viewed from the bottom side.

An inductor 1 according to this embodiment is used in a power supply circuit of an electronic device, such as a cellular phone, a portable music player, a portable video game machine and a compact camcorder, and comprises a drum core 2, a winding 3, and a pair of terminal portions 4A and 4B, as shown in FIG. 1.

As shown in FIG. 2, the drum core 2 integrally comprises a columnar winding portion 21 around which the winding 3 (see FIG. 1) is wound, and circular flange portions (an upper flange portion 22 and a lower flange portion 23) formed at the upper and lower ends of the winding portion 21 (in other words, the both ends in the direction of the axis C1 of the winding portion 21). For example, the drum core 2 is made of soft magnetic ferrite (alternatively, the drum core 2 can be made of permalloy, sendust, iron carbonyl, or a dust core formed by compression molding of fine powder of these materials). The upper flange portion 22 and the lower flange portion 23 have the same outer dimensions.

As shown in FIG. 3, each terminal portion 4A, 4B is formed by a metal plate member and has a joint 41 to which an end of the winding 3 (see FIG. 1) is connected, a mounting part 42 at which the terminal portion is mounted on a circuit board (see FIG. 7), and a pair of claw parts 43 that extend from one side edge of the mounting part 42 and are bent upward. As shown in FIG. 4, the joint 41 and the claw parts 43 of each terminal portion 4A, 4B protrude beyond the side surface of the lower flange portion 23, and each terminal portion 4A, 4B is securely fixed to the bottom surface of the lower flange portion 23 by an adhesive applied between the upper surface of the mounting part 42 and the bottom surface of the lower flange portion 23.

In the state shown in FIG. 4, which shows the terminal portions 4A, 4B securely fixed to the lower flange portion 23, one end part of the joint 41 is bent to the front. However, when or after an end of the winding 3 is connected to the joint 41, the bent part is deformed to extend upward as shown in FIG. 1.

The inductor 1 thus configured is mounted on a circuit board (see FIG. 7) with the bottom surface of the lower flange portion 23 facing the circuit board as shown in FIG. 1 and fixed to the circuit board by soldering the claw parts 43 of the terminal portions 4A, 4B to the circuit board surface. Whether the soldering is properly achieved or not can be confirmed by visually checking the state of the solder fillets (not shown) formed between the claw parts 43 and the circuit board surface.

Now, main characteristics of the inductor 1 will be described with reference to FIG. 5. FIG. 5 is a plan view of the embodiment of the present invention (in other words, a diagram showing an orthogonal projection of the inductor 1 in the direction of the axis C1).

As shown in FIG. 5, the inductor 1 is designed so that the projection area of each terminal portion 4A, 4B falls within a square 5 (shown by the chain double-dashed line in the drawing) that circumscribes the projection area of the upper flange portion 22 (or the lower flange portion 23) in the orthogonal projection of the inductor 1 in the direction of the axis C1. In addition, the projection areas of the ends of the winding 3 connected to the joints 41 of the respective terminal portions 4A, 4B fall within the square 5.

Thus, the footprint of the inductor 1 on the circuit board (see FIG. 7) is limited to within the square 5. Accordingly, the space for installing the inductor 1 can be easily secured on the circuit board, and another component can be efficiently and compactly arranged in the peripheral area of the square 5.

Now, an inductor according to another embodiment of the present invention will be described with reference to FIG. 6. FIG. 6 is a plan view of the inductor according to this embodiment of the present invention. In the embodiment shown in FIG. 6, components that are the same in concept as those shown in FIGS. 1 to 5 are denoted by the same reference numerals as those in FIGS. 1 to 5, and detailed descriptions thereof will be omitted.

An inductor 1A shown in FIG. 6 comprises a drum core 2, a winding 3 and a pair of terminal portions 4C, 4D. A characteristic of the inductor 1A consists in the configuration of each terminal portion 4C, 4D. Specifically, as shown in FIG. 6, the inductor 1A is designed so that the projection area of each claw part 43 of each terminal portion 4C, 4D is located in an inner area of the square 5 compared with that of the inductor 1 in the orthogonal projection of the inductor 1A in the direction of the axis C1. As a result, the projection area of a solder fillet 6 formed by soldering of each claw part 43 to a circuit board (see FIG. 7) also falls within the square 5.

Thus, the footprint of the inductor 1A on the circuit board including the solder fillet 6 is limited to within the square 5. Accordingly, compared with the inductor 1 described earlier, the space for installing the inductor 1A can be easily secured on the circuit board, and another component can be efficiently and compactly arranged in the peripheral area of the square 5.

While inductors according to embodiments of the present invention have been described, the present invention is not limited to the inductors according to the embodiments described above, and various modifications can be made thereto.

For example, while the upper flange portion 22 and the lower flange portion 23 of the drum core 2 have the same outer dimensions in the embodiments described above, a flange drum core having unequal diameter, which has a flange portions having different outer dimensions, can also be used (see FIG. 8). An inductor which has the flange drum core having unequal diameter can be designed so that the projection area of each terminal portion at least falls within a square that circumscribes the projection area of the flange portion having a larger or equal diameter.

The invention claimed is:

1. An inductor, comprising:

a drum core that has a winding portion and circular flange portions formed at both ends of the winding portion;

a winding that is wound around the winding portion; and a terminal portion being formed by a metal plate member and being securely fixed to an end face of one of the flange portions and has a joint to which an end of the winding is connected and a mounting part at which the inductor is mounted on a board, wherein, in an orthogonal projection of the inductor in the direction of an axis of the winding portion, all parts of the terminal portion at least fall within a square that circumscribes the flange portion that has a larger diameter of the flange portions formed at both ends of the winding portion.

2. The inductor according to claim 1 wherein, in the orthogonal projection, the projection area of a solder fillet formed by soldering of the terminal portion to the board falls within the square.

3. The inductor according to claim 2 wherein the flange portions have the same outer dimensions.

4. The inductor according to claim 1 wherein the flange portions have the same outer dimensions.

5. The inductor according to claim 1 wherein the terminal portion has a claw part in addition to the joint and the mounting part.

6. The inductor according to claim 5 wherein at least two claw parts are provided and abut against a side surface of one of the flange portions of the drum core.

7. The inductor according to claim 1 wherein the flange portions of the drum core have the same diameter.

8. A method of manufacturing an inductor wherein the method comprises:

a terminal disposing step of disposing all parts of a terminal, except a winding connecting terminal that is part of the terminal, to fall within a square that circumscribes one of two circular flange portions having a larger diameter, the two flange portions being formed at opposing ends of a drum core;

a winding forming step of forming a winding around the drum core;

a connecting step of fixing an end of the winding to a joint of the winding connecting terminal; and a bending step of bending the joint of the winding connecting terminal in a direction parallel to a winding axis of the drum core so that the winding connecting terminal falls within the square.

* * * * *